US005599399A

United States Patent [19]

Dujardin et al.

[11] Patent Number: 5,599,399

[45] Date of Patent: Feb. 4, 1997

[54] BATHS AND PROCESS FOR THE CHEMICAL POLISHING OF STAINLESS STEEL SURFACES

[75] Inventors: Francois Dujardin, Brussels; Marianne Reignier, Nivelles; Nathalie Barthelemy, Orp-Jauche, all of Belgium

[73] Assignee: Solvay et Cie (Societe Anonyme), Brussels, Belgium

[21] Appl. No.: 450,811

[22] Filed: May 25, 1995

Related U.S. Application Data

[63] Continuation of Ser. No. 177,707, Jan. 5, 1994, abandoned, which is a continuation of Ser. No. 920,446, filed as PCT/BE91/00010, Feb. 18, 1991 published as WO91/13187, Sep. 5, 1991, abandoned.

[30] Foreign Application Priority Data

Feb. 23, 1990 [BE] Belgium ..... 9000210

[51] Int. Cl.[6] ..... C09K 13/00; C09K 13/04; C23G 1/02; C23F 3/06

[52] U.S. Cl. ..... 134/3; 134/2; 134/41; 252/79.2; 252/79.4

[58] Field of Search ..... 134/3, 41; 252/79.2, 252/79.4

[56] References Cited

U.S. PATENT DOCUMENTS

| | | | |
|---|---|---|---|
| 2,446,060 | 7/1948 | Henry et al. | 252/101 |
| 3,125,475 | 3/1964 | Sidney et al. | 156/20 |
| 3,709,824 | 1/1973 | Oda et al. | 252/142 |
| 5,135,610 | 8/1992 | Tytgat et al. | 156/644 |
| 5,209,820 | 5/1993 | Tytgat et al. | 252/79.4 |

FOREIGN PATENT DOCUMENTS

| | | |
|---|---|---|
| 0019964 | 12/1980 | European Pat. Off. . |
| 1239172 | 6/1986 | U.S.S.R. . |
| 1140856 | 1/1969 | United Kingdom . |

*Primary Examiner*—Zeinab El-Arini
*Attorney, Agent, or Firm*—Emmanuel J. Lobato; Burns & Lobato, P.C.

[57] ABSTRACT

Process for chemical polishing of austenitic stainless steel surfaces using chemical polishing baths effective at a slow rate of reaction. The baths include in an aqueous solution a mixture of hydrochloric acid, nitric acid and phosphoric acid, an optionally substituted hydroxybenzoic acid, at least one quaternary ammonium salt and an additive chosen from perchloric acid and water-soluble salts of perchloric acid.

8 Claims, No Drawings

BATHS AND PROCESS FOR THE CHEMICAL POLISHING OF STAINLESS STEEL SURFACES

This is a continuation, of application Ser. No. 08/177,707, filed Jan. 5, 1994, now abandoned, which is a continuation of application Ser. No. 07/920,446, filed as PCT/BE91/00010, Feb. 18, 1991 published as WO91/13187, Sep. 5, 1991, now abandoned.

The present invention relates to the composition of baths for the chemical polishing of stainless steel surfaces.

Chemical polishing of metal surfaces is a well-known technique (Polissage electrolytique et chimique des metaux [Electrolytic and chemical polishing of metals] - W. J. McG. Tegart - Dunod - 1960 - p. 122 et seq.); it consists in treating the metal surfaces to be polished with oxidising baths. Baths comprising a mixture of hydrochloric, phosphoric and nitric acids in aqueous solution (U.S. Pat. No. 2,662,814) are generally employed for the chemical polishing of austenitic stainless steels. To improve the polishing quality, suitable additives are usually incorporated in these baths, such as surface-active agents, viscosity regulators and brightening agents. Thus, U.S. Pat. No. 3,709,824 describes a composition of a bath for the chemical polishing of stainless steel surfaces, comprising, in aqueous solution, a mixture of hydrochloric acid, nitric acid and phosphoric acid, a viscosity regulator chosen from water-soluble polymers, a surfactant, and sulphosalicylic acid as brightening agent.

These known polishing baths have the distinctive property of attacking the metal at a very high rate. A polishing treatment of a stainless steel surface with such baths generally cannot exceed a few minutes, or else it gives rise to localised corrosion phenomena. This high rate of action of the known polishing baths is a disadvantage because it renders them unusable for certain applications, especially for polishing the inner face of the walls of large vessels such as boilers, autoclaves or crystallisers. Since the time required to fill and to drain such vessels is generally much longer than the duration of the optimum chemical polishing treatment, it becomes impossible, in fact, to obtain a uniform polish of the wall, since some areas of the latter are insufficiently polished and others are deeply corroded. Furthermore, the high rate of action of the known chemical polishing baths makes the polishing difficult to control.

Patent EP-B-19,964 (Solvay & Cie) describes very slow-acting chemical polishing baths which consequently avoid the abovementioned disadvantages. These known baths comprise, in aqueous solution, a mixture of hydrochloric, nitric and phosphoric acids, sulphosalicylic acid, alkylpyridinium chloride and methyl cellulose. These known slow-acting polishing baths are designed to work at temperatures of at least 45° C., generally between 50° C. and 100° C.

The invention is aimed at providing baths designed to produce a slow and efficient chemical polishing of stainless steel surfaces at working temperatures below 50° C.

Consequently, the invention relates to baths for the chemical polishing of stainless steel surfaces, comprising, in aqueous solution, a mixture of hydrochloric acid, nitric acid and phosphoric acid, an optionally substituted hydroxybenzoic acid, at least one quaternary ammonium salt and an additive chosen from perchloric acid and the water-soluble salts of perchloric acid.

In the baths according to the invention the hydroxybenzoic acid is used as a brightening agent. It may be unsubstituted, such as salicylic acid, or substituted, such as sulphosalicylic acid. Salicylic acid is preferred.

The quaternary ammonium salt is preferably chosen from those containing at least one substituted or unsubstituted long-chain alkyl radical containing at least four carbon atoms. It is preferable to choose quaternary ammonium salts in which the long-chain alkyl group contains at least 8 carbon atoms, preferably at least 12 carbon atoms, such as, for example, the lauryl, cetyl and stearyl groups. Quaternary ammonium salts which are especially recommended belong to the class consisting of water-soluble alkylpyridinium salts and water-soluble quaternary ammonium salts containing, in addition to the long-chain alkyl radical defined above, at least one other substituted or unsubstituted alkyl radical and/or a substituted or unsubstituted benzyl radical. The halides, and in particular the chlorides, are preferred. Examples of quaternary ammonium salts which can be employed in the baths according to the invention are cetyltrimethylammonium chloride, cetyldimethylbenzylammonium chloride, distearyldimethylammonium chloride, lauryldimethylbenzylammonium chloride, lauryltrimethylammonium chloride and alkylpyridinium chlorides, especially cetylpyridinium chloride and laurylpyridinium chloride. These quaternary ammonium salts are available among the Dehyquart trademark products (Henkel).

In the baths according to the invention it is appropriate that the respective quantities of, on the one hand, the quaternary ammonium salt and, on the other hand, the additive chosen from perchloric acid and its water-soluble salts should be adjusted so as to permit a coadsorption on the surface of the steel to be polished, while avoiding exceeding their solubility product. As a general rule it is expedient that the baths according to the invention should contain, per litre, between 0.005 and 1 g of the quaternary ammonium salt and between 0.001 and 0.5 moles of the additive chosen from perchloric acid and its water-soluble salts.

The appropriate weight quantities of the various constituents of the baths according to the invention depend on the grade of the stainless steel subjected to polishing and on the polishing conditions, especially on the profile of the steel object subjected to polishing, its volume, the volume of the bath, its temperature and the stirring to which it may be subjected. They must therefore be determined by routine laboratory tests in each individual case. Examples of baths in accordance with the invention which are suitable for polishing chromium and nickel alloy austenitic stainless steels at temperatures of between 20° C. and 50° C. contain, per litre of aqueous solution:

- between 0.5 and 5 moles of hydrochloric acid (preferably 1–3 moles),
- between 0.005 and 1 mole of nitric acid (preferably 0.05–0.5 moles),
- between 0.005 and 1 mole of phosphoric acid (preferably 0.01–0.5 moles),
- between 0.0005 and 0.5 moles of the additive chosen from perchloric acid and the water-soluble salts of perchloric acid (preferably 0.001–0.2 moles),
- between 0.001 and 5 g of substituted or unsubstituted hydroxybenzoic acid (preferably 0.005–0.3 g in the case of the unsubstituted acid), and
- between 0.005 and 1 g of the quaternary ammonium salt (preferably 0.02–0.2 g).

The polishing baths according to the invention may optionally contain additives which are usually present in the known baths for the chemical polishing of metals, for example surface-active agents, alcohols and viscosity regulators. In particular, they may contain a water-soluble abietic compound which is a chemical compound containing an abietyl radical of general formula:

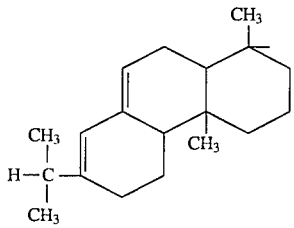

or a hydroabietyl or dehydroabietyl radical.

In accordance with the invention the abietic compound must be soluble in the aqueous solution.

Abietic compounds which can be employed in the baths according to the invention are the abietamines.

Abietamines which are especially recommended for the baths according to the invention are those of general formula:

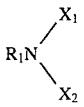

in which:

$R_1$ denotes an abietyl, hydroabietyl or dehydroabietyl radical defined above, $X_1$ denotes a radical containing at least one carbonyl group, and $X_2$ denotes a hydrogen atom or a radical containing at least one carbonyl group.

Examples of such abietamines which are suitable for the baths according to the invention are those in which at least one of the radicals $X_1$ and $X_2$ is a radical of general formula:

$$—CH_2—R_2$$

in which $R_2$ denotes a saturated or unsaturated, substituted or unsubstituted, linear or cyclic alkyl residue containing at least one carbonyl group. Among these compounds preference is given to those in which the $—CH_2—$group is linked to a carbonyl group of the $R_2$ residue by a carbon atom carrying at least one hydrogen atom. Such substituted abietamines and the means for obtaining them are described in patent GB-A-734,665. Examples of abietamines of this type which can be employed in the baths according to the invention are those in which the alkyl residue $R_2$ is chosen from acetonyl, 2-keto-butyl, 4-methyl-2-keto-3-pentenyl, 4-hydroxy-4-methyl-2-keto-pentyl, 2-ketocyclopentyl, 4-hydroxy-2-keto-3-pentenyl, 2-ketocyclohexyl, 2,5-diketohexyl and 2-phenyl-2-keto-ethyl residues.

The baths according to the invention are suitable for the chemical polishing of any surfaces made of austenitic stainless steel. They are especially suited to the polishing of austenitic steels containing between 16 and 26% by weight of chromium and between 6 and 22% by weight of nickel, such as the steels of molybdenum-free 18/8 and 18/10 grades (AISI steels 304 and 304L). The baths according to the invention have the distinctive characteristic of producing the polishing of such steels at a slow rate, generally requiring a contact time of between 5 and 12 hours. They can be employed at any temperatures between 20° C. and the boiling temperature. However, they have the remarkable particular characteristic of exhibiting an excellent effectiveness at temperatures below 50° C., generally between 35° and 45° C., at normal atmospheric pressure, and this makes them easier to use and simplifies the measures to be taken to ensure the healthiness of the polishing workshops. The baths according to the invention have the additional advantage of producing good quality polishes of assemblies which are welded according to the principles of the art.

The invention also relates to a process for polishing a stainless steel surface, according to which the surface is brought into contact with a chemical polishing bath in accordance with the invention.

In the implementation of the process according to the invention the contact between the metal surface and the bath may be brought about in any suitable manner, for example by immersion. The contact time between the surface to be polished and the bath must be sufficient to produce an effective polishing of the surface. However, it must not exceed a critical value beyond which the bath loses its polishing properties. The optimum contact time depends on many parameters such as the steel grade, the geometry and the initial roughness of the surface to be polished, the bath composition, the working temperature, any stirring of the bath in contact with the surface, and the relationship between the area of the surface to be polished and the volume of the bath; it must be determined by routine laboratory work in each individual case.

In a preferred embodiment of the process according to the invention the bath is used at a temperature of between 20° and 50° C., preferably between 35° and 45° C. at normal atmospheric pressure, and the surface to be polished is kept in contact with the bath for a period of between 5 and 12 hours.

The advantage of the invention will be revealed on reading the examples which are set out below.

The stainless steel panels which were employed in the examples whose description follows were of molybdenum-free 18/10 alloy steel grade [chromium (18.0%) and nickel (10.0%)].

In each example the panel was immersed in the polishing bath which was maintained at a substantially constant temperature and was subjected to moderate stirring. At the end of the immersion period the panel was taken out of the bath, rinsed with demineralised water and dried. The following parameters were measured:

the average depth of corrosion of the metal, defined by the relationship $$\Delta e=10^4+\Delta P / S+d$$

where

S denotes the area of the panel (in $cm^2$), d denotes the density of the metal (in $g/cm^3$), ΔP denotes the loss in weight (in g) of the panel during the immersion in the bath, Δe denotes the depth of corrosion (μm);

the arithmetic mean roughness $R_a$, which is the mean deviation relative to the mean surface of the panel (Encyclopedia of Materials Science and Engineering, Michael B. Bever, Vol. 6, 1986, Pergamon Press, pages 4806 to 4808 (page 4806):

$$R_a=(1/L)\int_0^L |y(x)|dx$$

the measurements being performed with a feeler equipped with a 5 μm-diameter point and corresponding to a cutoff value of 0.25 mm;

the surface brightness.

EXAMPLE 1

(in accordance with the invention)

A polishing bath in accordance with the invention was used, containing, per litre:

1.5 moles of hydrochloric acid, 0.2 moles of nitric acid, 0.2 moles of phosphoric acid, 0.2 moles of perchloric acid, 0.1 g of salicylic acid, 0.03 g of the product Dehyquart C, which is an electrolyte containing laurylpyridinium chloride as main constituent (Dehyquart is a registered trademark of Henkel).

The operating conditions were as follows:

| | |
|---|---|
| bath volume | 1940 $cm^3$, |
| area of the surface subjected to polishing | 87 $cm^2$, |
| temperature | 35° C., |
| immersion period | 12 hours 30 minutes. |

The following results were noted:

| | |
|---|---|
| average depth of attack | approximately 25 μm; |
| arithmetic mean roughness: | |
| before polishing | 0.3 ± 0.1 μm |
| after polishing | 0.12 ± 0.02 μm, |
| brightness | |
| at an angle of 30 degrees (according to ASTM standard E430): | 40% |
| at an angle of 20 degrees (according to ASTM standard D523): | 25% |

EXAMPLE 2

(in accordance with the invention)

A polishing bath in accordance with the invention was used, containing, per litre:

1.5 moles of hydrochloric acid, 0.2 moles of nitric acid, 0.2 moles of phosphoric acid, 0.005 moles of perchloric acid, 0.1 g of salicylic acid, 0.075 g of the product Dehyquart LDB (Henkel), which is an electrolyte containing lauryldimethylbenzylammonium chloride as main constituent.

The operating conditions were as follows:

| | |
|---|---|
| bath volume | 970 $cm^3$, |
| area of the surface subjected to polishing | 87 $cm^2$, |
| temperature | 35° C., |
| immersion period | 5 hours 30 minutes. |

The following results were noted:

| | |
|---|---|
| average depth of attack | 24 μm; |
| arithmetic mean roughness | |
| before polishing | 0.3 μm, |
| after polishing | 0.12 μm, |
| brightness [at an angle of 20 degrees (according to ASTM standard D523)] | 25% |

EXAMPLE 3

(reference)

The test of Example 2 was repeated with a chemical polishing bath not in accordance with the invention, containing no perchloric acid. The bath contained, per litre:

1.5 moles of hydrochloric acid, 0.2 moles of nitric acid, 0.2 moles of phosphoric acid, 0.1 g of salicylic acid, 0.075 g of the product Dehyquart LDB (Henkel), which is an electrolyte containing lauryldimethylbenzylammonium chloride as main constituent.

The operating conditions were as follows:

| | |
|---|---|
| bath volume | 970 $cm^3$, |
| area of the surface subjected to polishing | 87 $cm^2$, |
| temperature | 35° C., |
| immersion period | 6 hours. |

The following results were noted:

| | |
|---|---|
| average depth of attack | 25 μm; |
| arithmetic mean roughness | |
| before polishing | 0.3 μm, |
| after polishing | 0.3 μm, |
| brightness [at an angle of 20 degrees (according to ASTM standard D523)] | lower than 1%. |

EXAMPLE 4

(reference)

The test of Example 2 was repeated with a chemical polishing bath not in accordance with the invention, containing neither perchloric acid nor the electrolyte. The bath contained, per litre:

1.5 moles of hydrochloric acid, 0.2 moles of nitric acid, 0.2 moles of phosphoric acid, 0.1 g of salicylic acid.

The operating conditions were as follows:

| | |
|---|---|
| bath volume | 1940 $cm^3$, |
| area of the surface subjected to polishing | 87 $cm^2$, |
| temperature | 35° C., |
| immersion period | 6 hours 30 minutes. |

The following results were noted:

| | |
|---|---|
| average depth of attack | 25 μm; |
| arithmetic mean roughness | |
| before polishing | 0.20 μm, |
| after polishing | 0.25 μm, |
| brightness [at an angle of 20 degrees (according to ASTM standard D523)] | lower than 1%. |

We claim:

1. Process for polishing an austenitic stainless steel surface comprising, bringing the surface into contact with a chemical polishing bath for the chemical polishing of stainless steel surfaces at a slow rate of reaction, said bath comprising, in an aqueous solution, a mixture of hydrochloric acid, nitric acid and phosphoric acid, a brightening agent chosen from substituted and unsubstituted hydroxybensoic acids, and at least one quaternary ammonium salt comprising at least one alkyl radical containing 4 carbon atoms, characterized in that they contain, per liter of the aqueous solution, between 0.005 and 1 g of quaternary ammonium salt, and between 0.001 and 0.5 moles of an additive chosen from perchloric acid and water-soluble salts of perchloric acid, effective to permit coadsorption of the quaternary ammonium salt and of the additive chosen from perchloric acid and the water-soluble salts of perchloric acid on the surface of the steel for chemically polishing the steel surface, said bath being at a working temperature of between 20° and 50° C. in use, and said polishing bath being in contact with the stainless steel surface for a period of 5 to 12 hours for effecting said chemical polishing.

2. The process according to claim 1, in which the chemical polishing bath contains per liter of aqueous solution, between 0.5 and 5 moles of hydrochloric acid, between 0.005 and 1 mole of nitric acid, between 0.005 and 1 mole of phosphoric acid, between 0.0005 and 0.5 moles of the additive chosen from perchloric acid and the water-soluble salts of perchloric acid, between 0.001 and 5 g of hydroxybenzoic acid, and between 0.005 and 1 g of quaternary ammonium salt.

3. The process according to claim 1, in which the chemical polishing bath contains per liter of aqueous solution, between 1 and 3 moles of hydrochloric acit, between 0.05 and 0.5 moles of nitric acid, between 0.01 and 0.5 moles of phosphoric acid, between 0.001 and 0.2 moles of the additive chosen from perchloric acid and the water-soluble salts of perchloric acid, between 0.005 and 0.3 of the unsubstituted acid, and between 0.02 and 0.2 of the quaternary ammonium salt.

4. Process for polishing inner faces of walls of a large vessel made of an austenitic stainless steel, comprising, filling said vessel with a chemical polishing bath for the chemical polishing of stainless steel surfaces at a slow rate of reaction, said bath comprising, in an aqueous solution, a mixture of hydrochloric acid, nitric acid and phosphoric acid, a brightening agent chosen from substituted and unsubstituted hydroxybenzoic acids, and at least one quaternary ammonium salt comprising at least one alkyl radical containing 4 carbon atoms, characterized in that they contain, per liter of the aqueous solution, between 0.005 and 1 g of quaternary ammonium salt, and between 0.001 and 0.5 moles of an additive chosen from perchloric acid and water-soluble salts of perchloric acid, effective to permit the coadsorption of the quaternary ammonium salt and of the additive chosen from perchloric acid and the water-soluble salts of perchloric acid on the surface of the steel for chemical polishing of the steel surface, and said bath being at a working temperature of between 20° and 50° C. in use;

maintaining said polishing bath in contact with the stainless steel surface at a working temperature of between 20° and 50° C. for a period of 5 to 12 hours for effecting said chemical polishing at a slow rate of reaction; and removing said polishing bath from the vessel.

5. Process according to claim 4, in which the large vessel is either a boiler, an autoclave or a crystallizer.

6. A chemical polishing bath for chemical polishing of austenitic steel surfaces at a slow rate of reaction comprising, in an aqueous solution, a mixture of hydrochloric acid, nitric acid and phosphoric acid, a brightening agent chosen from substituted and unsubstituted hydroxybenzoic acids, and at least one quaternary ammonium salt comprising at least one alkyl radical containing 4 carbon atoms, characterized in that they contain, per liter of the aqueous solution, between 0.005 and 1 g of quaternary ammonium salt, and between 0.001 and 0.5 moles of an additive chosen from perchloric acid and water-soluble salts of perchloric acid, effective to permit coadbsorption of the quaternary ammonium salt and of the additive chosen from perchloric acid and the water-soluble salts of perchloric acid on the surfaces of the steel for chemically polishing the steel surfaces, and said bath being at a working temperature of between 20° and 50° C. in use, and said polishing bath being in contact with a stainless steel surfaces for a period of 5 to 12 hours for effecting said chemical polishing at a slow rate of reaction.

7. A chemical bath according to claim 6 in which the bath contains per liter of aqueous solution, between 0.5 and 5 moles of hydrochloric acid, between 0.005 and 1 mole of nitric acid, between 0.005 and 1 mole of phosphoric acid, between 0.0005 and 0.5 moles of the additive chosen from perchloric acid and the water-soluble salts of perchloric acid, between 0.001 and 5 g of hydroxybenzoic acid, and between 0.005 and 1 g of quaternary ammonium salt.

8. A chemical bath according to claim 6, in which the bath contains per liter of aqueous solution, between 1 and 3 moles of hydrochloric acid, between 0.05 and 0.5 moles of nitric acid, between 0.01 and 0.5 miles of phosphoric acid, between 0.001 and 0.2 moles of the additive chosen from perchloric acid and the water-soluble salts of perchloric acid, between 0.005 and 0.3 g of the unsubstituted acid, and between 0.02 and 0.2 of the quaternary ammonium salt.

* * * * *